US009027814B2

(12) United States Patent
Tages et al.

(10) Patent No.: US 9,027,814 B2
(45) Date of Patent: May 12, 2015

(54) HOLSTER ACCOMMODATING DIFFERENT SIZED PORTABLE DEVICE CASES

(75) Inventors: Fernando Tages, Coral Springs, FL (US); Daniel Acero, Miramar, FL (US); Jorge Sotelo, Doral, FL (US)

(73) Assignee: A.G. Findings & Mfg. Co., Inc., Fort Lauderdale, FL (US)

( * ) Notice: Subject to any disclaimer, the term of this patent is extended or adjusted under 35 U.S.C. 154(b) by 286 days.

(21) Appl. No.: 13/428,077

(22) Filed: Mar. 23, 2012

(65) Prior Publication Data

US 2012/0325882 A1 Dec. 27, 2012

Related U.S. Application Data

(60) Provisional application No. 61/499,478, filed on Jun. 21, 2011.

(51) Int. Cl.
*A45F 5/00* (2006.01)
*A45F 5/02* (2006.01)

(52) U.S. Cl.
CPC ..... *A45F 5/021* (2013.01); *Y10S 224/93* (2013.01); *A45F 2200/0516* (2013.01); *A45F 2200/0525* (2013.01)

(58) Field of Classification Search
CPC ..... A45F 2200/0508; A45F 2200/0516; A45F 2200/0525
USPC ..... 224/245, 929, 930, 242; D3/218; D14/447, 250, 251, 252, 253
See application file for complete search history.

(56) References Cited

U.S. PATENT DOCUMENTS

| | | | | |
|---|---|---|---|---|
| 2,004 | A | 3/1841 | Harris et al. | |
| 89,570 | A | 5/1869 | Fellows | |
| 3,777,953 | A * | 12/1973 | Lewis | 368/281 |
| 4,006,764 | A | 2/1977 | Yamamoto et al. | |
| 4,299,344 | A * | 11/1981 | Yamashita et al. | 224/242 |
| 4,584,718 | A | 4/1986 | Fuller | |
| 4,703,161 | A | 10/1987 | McLean | |
| 5,025,921 | A | 6/1991 | Gasparaitis et al. | |
| 5,060,260 | A * | 10/1991 | O'Connell | 379/454 |
| 5,175,873 | A | 12/1992 | Goldenberg et al. | |
| 5,386,084 | A | 1/1995 | Risko | |
| 5,586,002 | A | 12/1996 | Notarianni | |
| 5,713,466 | A | 2/1998 | Tajima | |
| 5,785,222 | A * | 7/1998 | Basso et al. | 224/555 |
| 5,812,188 | A | 9/1998 | Adair | |
| 5,988,577 | A * | 11/1999 | Phillips et al. | 248/231.81 |
| 5,990,874 | A | 11/1999 | Tsumura et al. | |
| 5,996,790 | A | 12/1999 | Yamada et al. | |
| 6,031,524 | A | 2/2000 | Kunert | |
| 6,052,279 | A | 4/2000 | Friend et al. | |
| 6,138,826 | A | 10/2000 | Kanamori et al. | |
| 6,176,401 | B1 * | 1/2001 | Lim | 224/196 |
| 6,317,313 | B1 | 11/2001 | Mosgrove et al. | |
| 6,349,824 | B1 | 2/2002 | Yamada | |
| 6,415,138 | B2 | 7/2002 | Sirola et al. | |
| 6,426,870 | B1 | 7/2002 | Oross et al. | |
| 6,525,928 | B1 | 2/2003 | Madsen et al. | |
| 6,532,152 | B1 | 3/2003 | White et al. | |

(Continued)

*Primary Examiner* — Justin Larson
(74) *Attorney, Agent, or Firm* — Christopher & Weisberg, P.A.

(57) ABSTRACT

A holster for a mobile device case having a first predetermined configuration and a second predetermined configuration. The holster includes a base sized to releasably affix the mobile device case independent of whether the mobile device case is in the first predetermined configuration or the second predetermined configuration.

19 Claims, 7 Drawing Sheets

(56) References Cited

U.S. PATENT DOCUMENTS

| | | | | |
|---|---|---|---|---|
| 6,536,589 | B2 | 3/2003 | Chang | |
| 6,608,119 | B2 | 8/2003 | Tanabe et al. | |
| 6,646,864 | B2 | 11/2003 | Richardson | |
| 6,646,866 | B2 | 11/2003 | Kao | |
| 6,659,274 | B2 | 12/2003 | Enners | |
| 6,721,651 | B1 | 4/2004 | Minelli | |
| 6,785,566 | B1 | 8/2004 | Irizarry | |
| 6,844,845 | B1 | 1/2005 | Whiteside et al. | |
| 6,896,134 | B2 | 5/2005 | Russell et al. | |
| 6,983,130 | B2 | 1/2006 | Chien et al. | |
| 6,995,976 | B2 | 2/2006 | Richardson | |
| 7,069,063 | B2 | 6/2006 | Halkosaari et al. | |
| D529,713 | S * | 10/2006 | Guyot et al. | D3/218 |
| 7,130,185 | B2 | 10/2006 | Chen et al. | |
| 7,158,376 | B2 | 1/2007 | Richardson et al. | |
| 7,180,735 | B2 | 2/2007 | Thomas et al. | |
| 7,230,823 | B2 | 6/2007 | Richardson et al. | |
| 7,312,984 | B2 | 12/2007 | Richardson et al. | |
| 7,609,512 | B2 | 10/2009 | Richardson et al. | |
| D615,535 | S | 5/2010 | Richardson et al. | |
| 7,907,394 | B2 | 3/2011 | Richardson et al. | |
| D697,515 | S * | 1/2014 | Adelman et al. | D14/447 |
| 8,668,123 | B2 * | 3/2014 | Richmond | 224/312 |
| 2002/0137475 | A1 | 9/2002 | Shou et al. | |
| 2003/0217940 | A1 | 11/2003 | Russell et al. | |
| 2004/0089570 | A1 | 5/2004 | Chien et al. | |
| 2005/0139498 | A1 | 6/2005 | Goros | |
| 2006/0231713 | A1 * | 10/2006 | Crain et al. | 248/309.1 |
| 2010/0008028 | A1 | 1/2010 | Richardson et al. | |
| 2011/0226545 | A1 | 9/2011 | Richardson et al. | |
| 2011/0228458 | A1 | 9/2011 | Richardson et al. | |
| 2011/0228459 | A1 | 9/2011 | Richardson et al. | |

* cited by examiner

HOLSTER ACCOMMODATING DIFFERENT SIZED PORTABLE DEVICE CASES

CROSS-REFERENCE TO RELATED APPLICATION

This application is related to and claims priority to U.S. Provisional Application Ser. No. 61/499,478, filed Jun. 21, 2011, the entirety of which is incorporated herein by reference.

STATEMENT REGARDING FEDERALLY SPONSORED RESEARCH OR DEVELOPMENT n/a

FIELD OF THE INVENTION

The present invention relates to portable device cases and, in particular, a holster accommodating differently sized portable device cases.

BACKGROUND OF THE INVENTION

Mobile device cases come in various shapes and sizes depending on the corresponding mobile device to be retained within. Such cases may also include one or more protective skins disposed around the exterior of the case to provide additional protection for such mobile devices. For example, a case composed of substantially rigid material may also include a removable softer skin disposed around its exterior to absorb an impact force. Users of such mobile device cases, therefore, have cases that define multiple shapes and sizes, and include multiple layers of material, depending on the preference of the user and the design of the mobile device case.

Users of mobile device cases also often prefer to clip their mobile device cases to their waist belts or on a strap for a handbag. However, such holsters are sized to receive a single configuration of a mobile device case. For example, currently available holsters are sized to retain a mobile device case having protective skin or without—but not both. As such, what is needed is a holster capable of accommodating the various configurations a mobile device case may have for a particular mobile device.

SUMMARY OF THE INVENTION

The present invention advantageously provides a holster for a mobile device case having a first predetermined configuration and a second predetermined configuration. The holster includes a base sized to releasably affix the mobile device case independent of whether the mobile device case is in the first predetermined configuration or the second predetermined configuration.

In another embodiment, the holster includes a base dimensioned to securably and releasably retain a mobile device case having a first configuration and a second configuration. The first configuration includes a housing having a first portion removeably coupled to a second portion. The second configuration includes an elastomeric cover substantially surrounding the first configuration. The base includes a latch operable to releaseably affix the mobile device case to the base in both the first configuration and second configuration.

In yet another embodiment, a method of manufacturing a holster for a mobile device case having a first predetermined configuration and a second predetermined configuration. The method includes molding a base sized to releasably affix the mobile device case independent of whether the mobile device case is in the first predetermined configuration or the second predetermined configuration.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
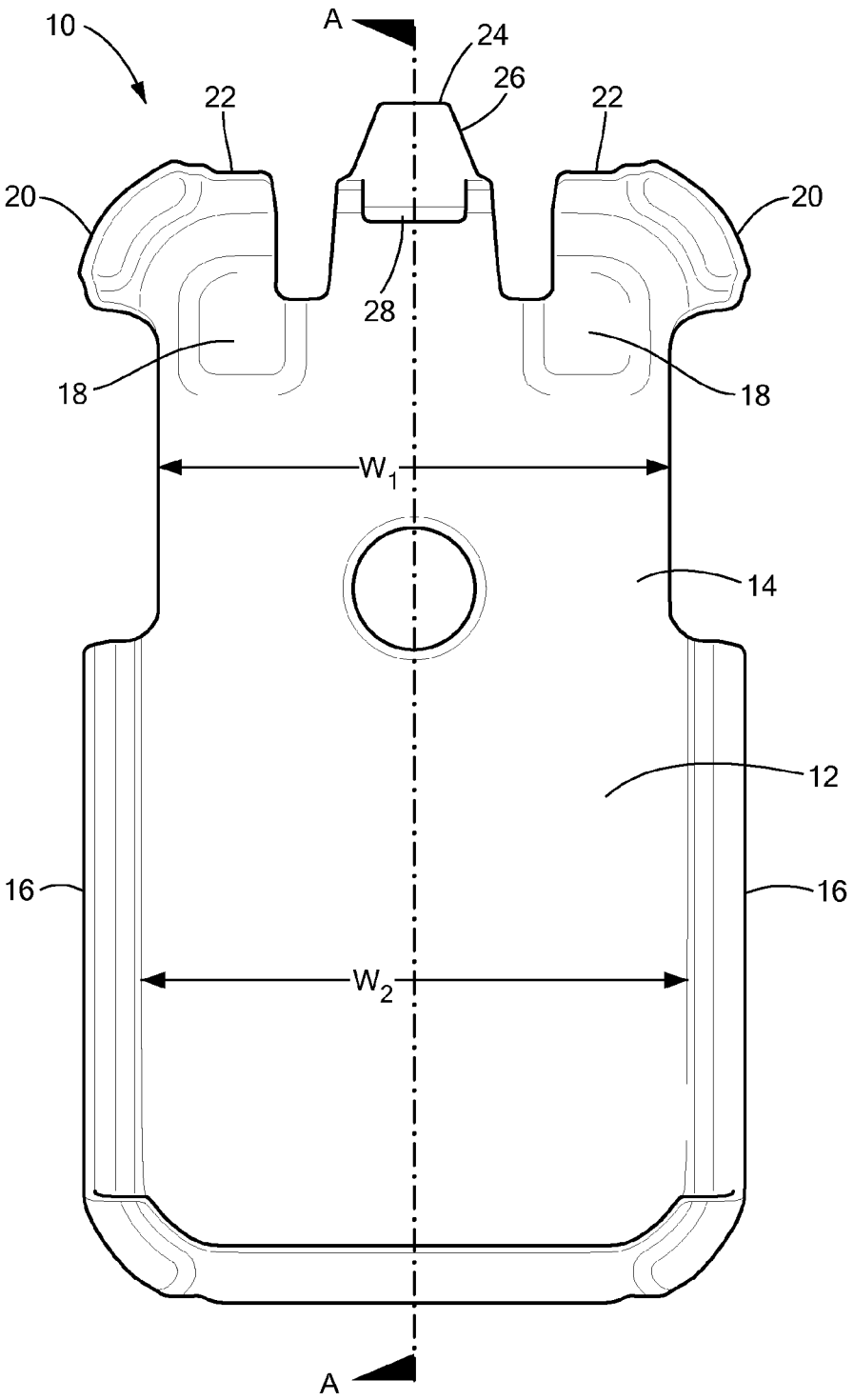
FIG. 1 is a front view of an exemplary holster constructed in accordance with the principles of the present invention.

Now referring to the drawings in which like reference designators refer to like elements, there is shown in FIG. 1 a holster constructed in accordance with the principles of the present invention and designated generally as "10." The holster 10 may include a base 12 sized to receive, releasable secure, and at least partially surround a mobile device case having multiple configurations. For example, the base 12 may define a height, width, depth sufficient to accommodate various configurations of the same mobile device case. The base 12 may be composed of a substantially rigid material, for example, polycarbonate, or a material with a similar hardness and may also include soft resilient material, such as thermoplastic polyurethane molded or silicone, otherwise included on the base 12.

The base 12 may include a substantially planar portion 14 sized to contour a front portion of the mobile device case. The planar portion 14 may be dimensioned depending on the dimensions of the mobile device case to be retained by the base 12. As used herein, the front portion of the mobile device case refers the portion of the device case facing the user when the user operates a keypad or touch-screen depending on the device. For example, the front portion of the mobile device case may be pressed against a portion of the planar portion 14 such that that touch-screen on the mobile device is protected from scratching and accidental activation when the holster 10 is clipped or otherwise to the user's belt. The planar portion 14 may define a smaller transverse width "$W_1$" toward the top of the holster 10. The smaller transverse width may allow the mobile device case to be gripped so that it may be removed from the holster 10. The planar portion 14 may further define a larger transverse width "$W_2$" toward the bottom portion of the holster 10.

The base 12 may further include a pair of extensions 16 extending from the larger transverse width section of the planar portion 14. The extensions 16 may extend outward from both sides of the larger transverse width section and may surround at least a portion of the mobile device case. For example, when a mobile device is coupled to the holster, the extensions 16 operate to at least partially surround at least a portion of the mobile device case within the holster 10. The extensions 16 may each define dimensions sufficient to prevent the mobile device case from moving laterally within the holster 10. For example, the extensions 16 may be curved in shape, or alternatively may be substantially linear in shape, and extend outward from the planar portion 14 in a direction substantially orthogonal to the planar portion 14.

The base 12 may further define a pair of protuberances 18 raised from the surface of the planar portion 14. The protuberances 18 may be substantially rectangular in shape, or any shape, and sized to contact corresponding resilient pieces (not shown) on the front portion of the mobile device case. The protuberances 18 may operate to space the mobile device case a distance from a portion of the planar portion 14, such that the mobile device case may be gripped and removed from the holster 10. For example, the protuberances 18 may operate to form a common contact point for the multiple configurations of the mobile device case within the holster 10. The protuberances 18 may further operate to space a touch-screen of the mobile device a distance away from the planar portion 14 such that should impact occur the touch-screen does not contact the planar portion 14 and potentially fracture the screen. Rather, should a pushing force be applied to the mobile device case when retained within the holster 10, the resilient pieces on the mobile device case contact the protuberance 18 and absorb a substantial portion of the pushing force without the touch-screen contacting the planar portion 14.

The base 12 may further include the plurality of arms 20 extending outward from the planar portion 14. The arms 20 may be substantially dimensioned to receive corner portions included on the mobile device case. For example, the arms 20 may define a curvature similar to the curvature of the corners of the mobile device case. In particular, the arms 20 may define a substantially concave region defining a concavity sized to receive a substantially convex portion defined by the corner portions. In a configuration, the height of the arms 20 may be greater than the height of the extensions 16, but less than the height of the mobile device case. As used herein, the height of the arms 20 and the extensions 16 refers to the distance each of those respective components extend away in from the planar portion 14 in a substantially orthogonal direction. The arms 20 may further define a tapered height portion 22 (best shown in FIG. 2) decreasing in height as it extends toward the midline of the base 12. The tapered height portions 22 provide an access point to the mobile device case when disposed within the holster 10 and may allow for the mobile device case to be snapped into and removed from the holster 10.

Continuing to refer to FIG. 1, the base 12 may further include a resilient and pressable latch 24 near the top portion of the base 12. The latch 24 may be separated from each of the arms 20 by a void in the base adjacent each arm 20. In particular, the latch 24 may define a pressable surface 26 defining a substantially planar surface sized to accommodate the surface of the fingers of the user. The pressable surface 26 may be angled or may be substantially parallel to the planar portion 14. Extending downward from a portion of the pressable surface 26 is an engagement element 28, for example, a hook or tab, sized to be received within a corresponding recess 30 (best seen in FIG. 5) defined by the mobile device case. For example, the engagement element 28 may extend downward substantially orthogonally from the pressable surface 26. The engagement element 28 may further be sized to snap-fit within the recess 30. In an exemplary operation, the bottom portion of the mobile device case may be placed within a portion of the holster 10. The top portion of the mobile device case may then be pressed against the engagement element 28 causing it to move upward and snap into the recess 30, securing the device case to the holster 10. To remove the mobile device case from the holster 10, a pushing force applied to the pressable surface 26 forces the engagement element 28 out of the recess 30 releasing the latch 24 from the mobile device case.

Figure 2:
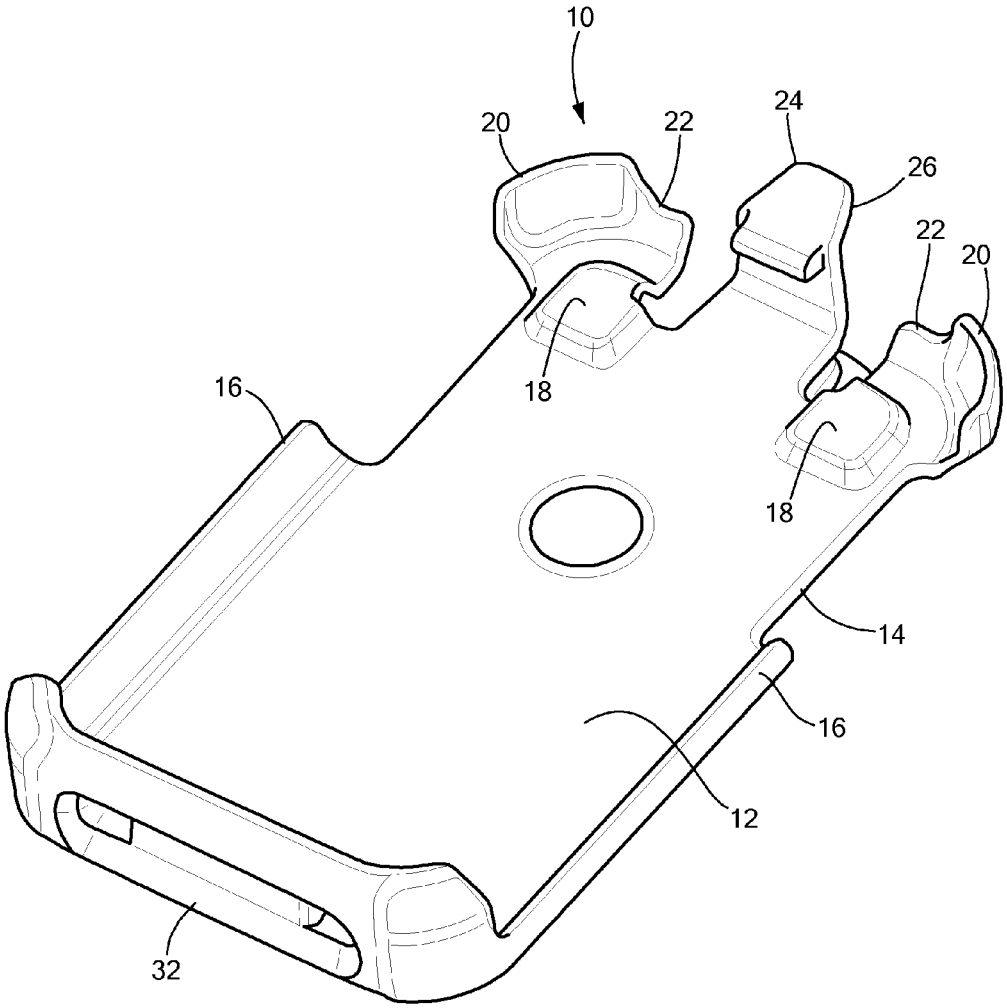
FIG. 2 is a front perspective view of the holster shown in FIG. 1.

Now referring to FIG. 2, the extensions 16 may be contiguous with and spanned by a ledge 32 sized to retain the bottom portion of the mobile device case. The ledge 32 may extend substantially orthogonally away from the planar portion 14 and/or the extensions 16. The ledge 32 may define substantially curved corners and edges sized to receive the corresponding corners of the mobile device case. For example, the ledge 32 may define a concavity sized to receive the bottom portion of the mobile device case.

Figure 3:
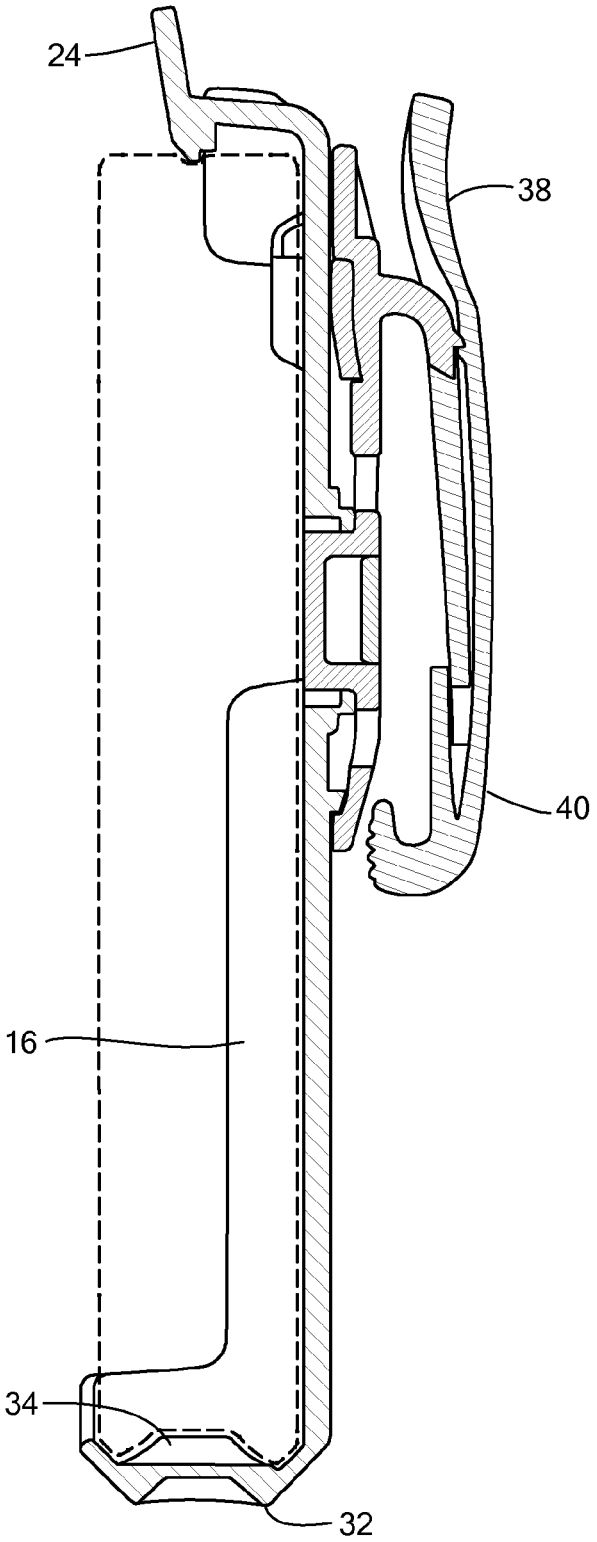
FIG. 3 is a side cross-sectional view of the holster shown in FIG. 1 taken through Section A-A.

Now referring to FIG. 3, the ledge 32 may further include a pair of nubs 34 disposed at approximately the mid-height of the ledge 32. The nubs 34 may be raised a distance from the ledge 32 and extend in an inward direction substantially parallel to the planar portion 14. The nubs 34 may be operable to engage corresponding indentations or flexible pieces on the device case (not shown) such that the nubs 34 contact the indentations to hold the device case within the holster. For example, if a downward pushing force is applied to the mobile device case when it is disposed within the holster 10, the nubs 34 may contact the indentations and absorb at least a portion of the force applied by the mobile device case on the nubs 34.

Figure 4:
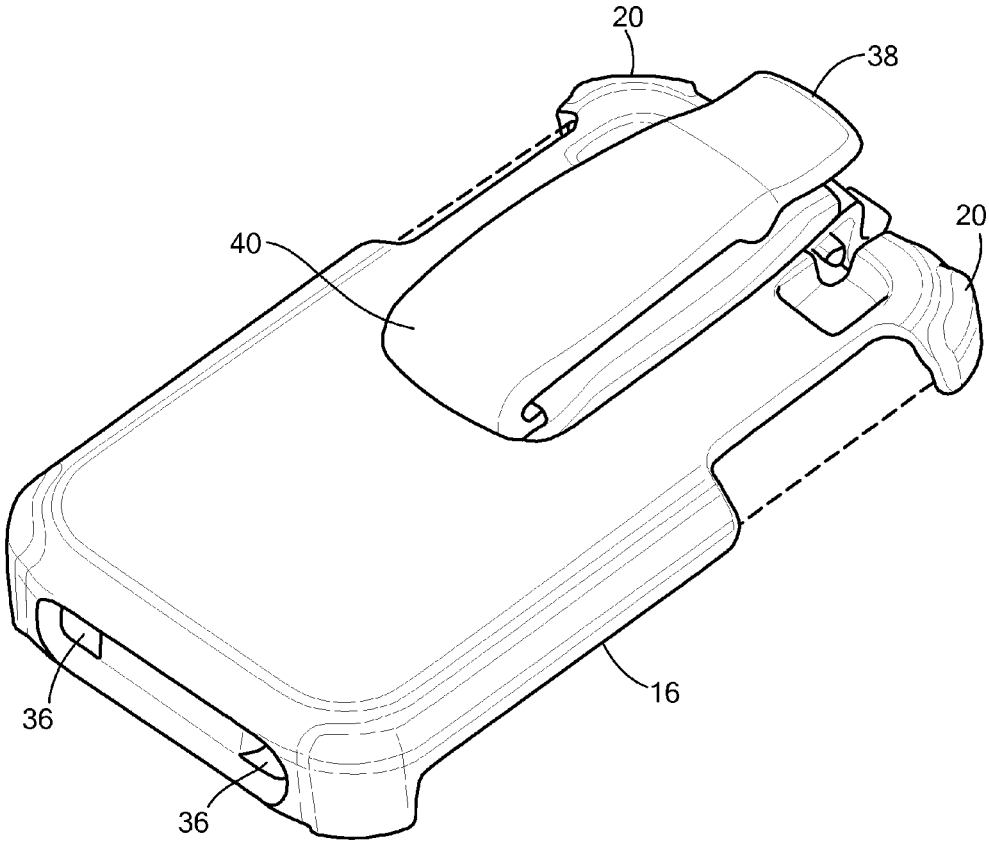
FIG. 4 is a back perspective view of the holster shown in FIG. 1.

Now referring to FIG. 4, each nub 34 may further define apertures 36 commensurate in size with mobile device speakers that may be disposed on the bottom portion of the mobile device. For example, when the mobile device case is disposed within the holster 10, the speakers of the mobile device may be disposed proximate the apertures 36 such that sound emitted from the speakers is not substantially dampened by presence of the mobile device within the holster 10.

The holster 10 may further define a clip assembly 38 movably and rotatably coupled to the rear of the base 12. The clip assembly 38 may include a fastener 40 sized to engage a user's waist belt or should straps of a hand bag. In an exemplary embodiment, the holster 10 may be removeably attached to a user's waist belt by the fastener 40 and be rotated to a desired angle on the waist belt.

Figure 5:
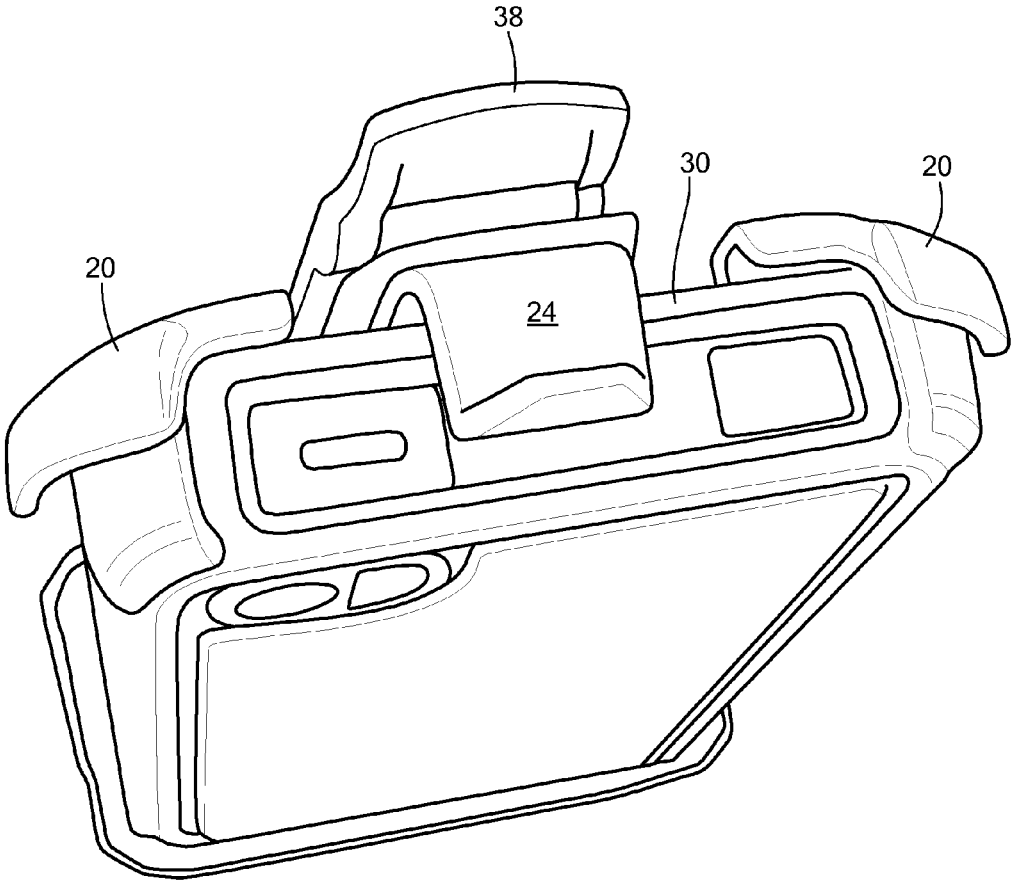
FIG. 5 is a top perspective view of the holster shown in FIG. 1 with a mobile device coupled to the holster.
Figure 6:
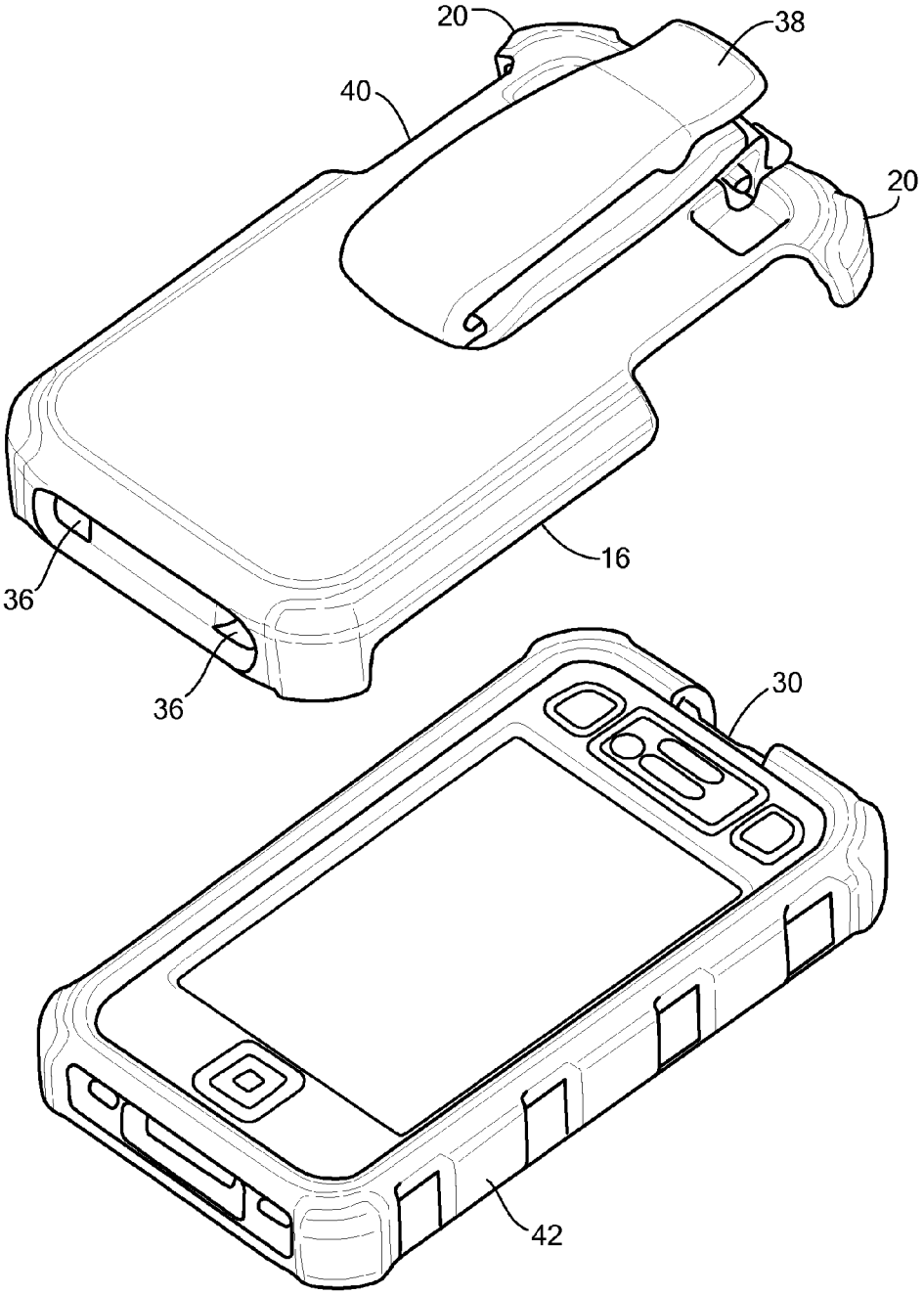
FIG. 6 is a back perspective view of the holster shown in FIG. 4 with the mobile device including an additional layer of protection.

Now referring to FIGS. 5 and 6, the engagement element 28 may be at least partially insertable within the recess 30 defined by the mobile device case and operable to secure the holster 10 to the mobile device case. The engagement element 28 may engage the recess 30 whether the mobile device case includes a protective outer cover 42 (FIG. 6) or not (FIG. 5) such that the holster 10 may accommodate multiple configurations of a mobile device case by providing sufficient clearance and size within in the planar portion 14, extensions 16, and arms 20 to accommodate the protective outer cover 42.

Figure 7:
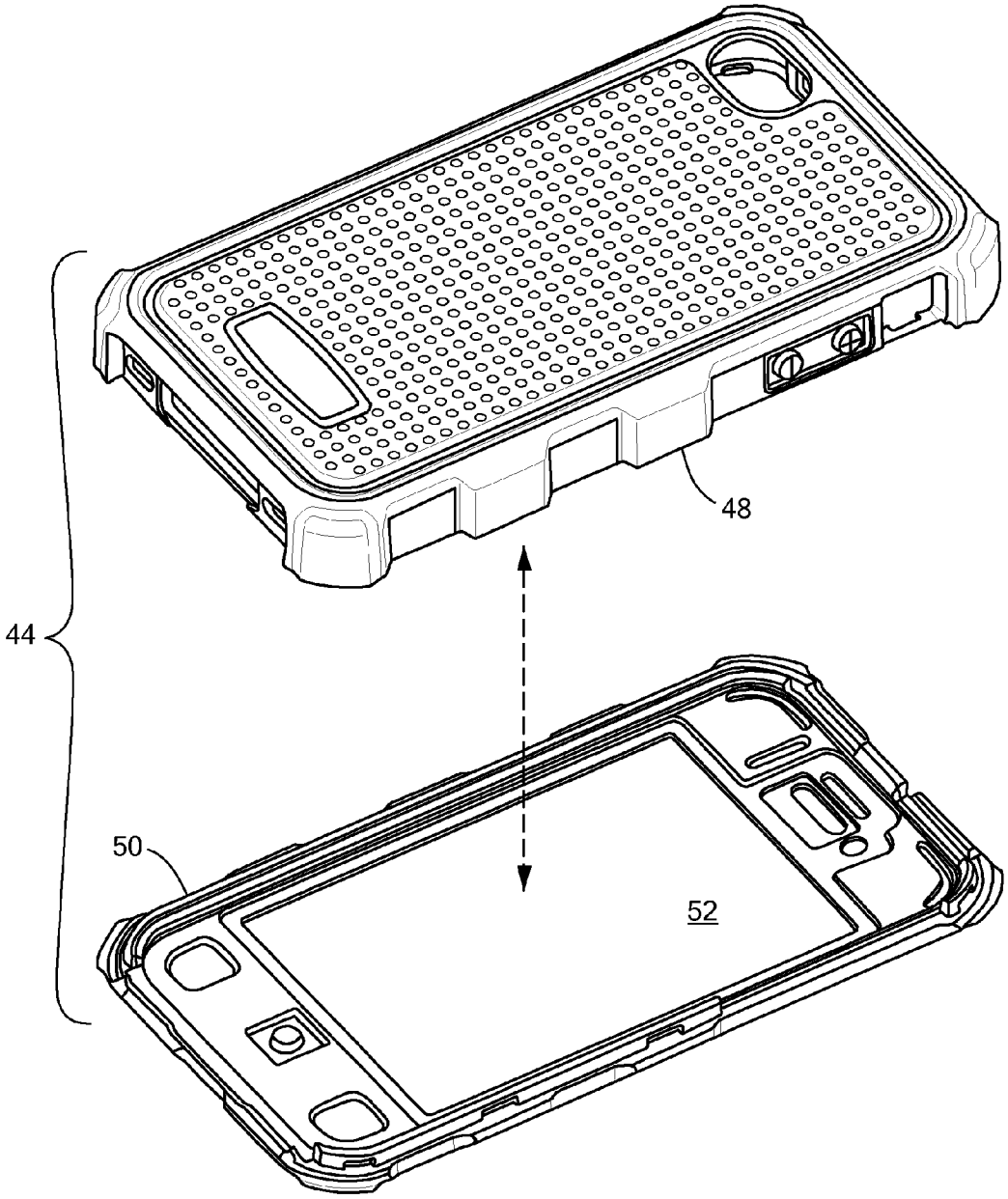
FIG. 7 is an exploded perspective view of the housing of the mobile device case shown in FIG. 5.

For example, as shown in FIG. 7, the mobile device case may include a first configuration which includes a housing 44 in which the mobile device is retained. The housing 44 may include a first portion 46 pre-fabricated to contour a specific mobile device, for example an iPhone, iPad or other mobile phone or tablet computer, and thus may vary depending on the size of the mobile device. The first portion 46 may further include a side wall 48 surrounding the first portion 14 and may define a height substantially commensurate with a height of the mobile device housed within the first portion 14, or any height. Removeably coupled to the first portion 46 is a second portion 50 which encloses the mobile device within the first portion 46. The second portion 50 may include a substantially transparent membrane 52 which allows for operation of a touch screen of the mobile device.

A second configuration of the mobile device case may include the protective cover 42 disposed around the housing 44, for example a silicon cover, or other similar elastomeric cover, sized to substantially cover the mobile device case. When disposed around the device case, the silicon cover 42 increases the volume and area the device case occupies within the holster 10. However, with or without the silicon cover 42, the latch 24 locks the device case within the holster 10 and the base 12 and the arms 20 define a sufficient volume and area to house both the first and second configurations of the device case. The latch 24 may lock the mobile device case in the first configuration and the second configuration because the recess 32 remains accessible to the latch 24 whether the silicon cover is disposed around the device case or is absent. To further aide in accommodating both the first and the second configurations, the nubs 34 and the protuberances 18 to provide a common contact/resting point for the mobile device case in either configuration. In particular, the nubs 34 and protuberance 18 contact the mobile device case at substantially the same location whether the protective cover 42 is disposed around the mobile device case or not.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

What is claimed is:

1. A holster kit comprising:

a mobile device case, the mobile device case having a front portion, a first predetermined configuration, a second predetermined configuration, and the first predetermined configuration and the second predetermined configuration being differently dimensioned;

a base sized to releasably affix the mobile device case, the base including an at least substantially planar portion sized to contour the front portion of the mobile device case, the at least substantially planar portion including a plurality of protuberances configured to form a first common contact point for the mobile device case when the mobile device case is releasably affixed to the base in both the first predetermined configuration and the second predetermined configuration, the base having a fixed size to receive the first predetermined configuration and the second predetermined configuration of the mobile device case; and a retention element configured to releasably mate with a corresponding second common contact point in both the first predetermined configuration and the second predetermined configuration, the plurality of protuberances configured to maintain the alignment between the retention element and the second common contact point in both the first predetermined configuration and the second predetermined configuration without changing the position of the second common contact point.

2. The holster of claim 1, wherein the base includes a plurality of arms sized to engage at least a portion of the mobile device case.

3. The holster of claim 1, wherein the base includes a rotatable fastener.

4. The holster of claim 1, wherein the first predetermined configuration of the mobile device case has a housing including a first portion removeably coupled to a second portion.

5. The holster of claim 4, wherein the second predetermined configuration of the mobile device case includes an elastomeric cover covering at least a portion of the housing.

6. The holster of claim 1, wherein the base includes a latch, and wherein the latch is engageable with the mobile device case in both the first predetermined configuration and the second predetermined configuration.

7. The holster of claim 6, wherein the latch includes an engagement element and wherein the mobile device case includes a recess, and wherein the engagement element is sized to be received within the recess.

8. The holster of claim 1, wherein the base includes a first transverse width and a second transverse width, the first transverse width being smaller than the second transverse width.

9. The holster of claim 8, wherein the base includes a pair of extensions defined along distal ends of the second transverse width.

10. A system, comprising:

a mobile device case having:

a front portion;

a first predetermined configuration a second predetermined configuration and the first predetermined configuration and the second predetermined configuration being differently dimensioned;

a base having:

an at least substantially planar portion sized to contour the front portion of the mobile device case;

the at least substantially planar portion including a plurality of protuberances configured to form a first common contact point for the mobile device case when the mobile device case is releasable affixed to the base in both the first predetermined configuration and the second predetermined configuration;

a fixed size to receive the first predetermined configuration and the second predetermined configuration of the mobile device case; and a retention element configured to releasably mate with a corresponding second common contact point in both the first predetermined configuration and the second predetermined configuration, the plurality of protuberances configured to maintain the alignment between the retention element and the second common contact point in both the first predetermined configuration and the second predetermined configuration without changing the position of the second common contact point.

11. The system of claim 10, further including a rotatable fastener affixed to the base.

12. The system of claim 10, wherein the plurality of protuberances are configured to space the mobile device case a distance from the base when the mobile device is retained with the housing.

13. The system of claim 10, wherein the base includes a first transverse width and a second transverse width, the first transverse width being smaller than the second transverse width.

14. The system of claim 13, wherein the base includes a pair of extensions defined along distal ends of the second transverse width.

15. The system of claim 10, wherein the base includes a plurality of arms sized to engage at least a portion of the mobile device case.

16. The system of claim 10, wherein the base includes a ledge sized to retain a substantial portion of the mobile device case.

17. The system of claim 10, wherein the retention element is a latch having an engagement element and wherein the mobile device case includes a recess, and wherein the engagement element is sized to be received within the recess.

18. The system of claim 10, wherein the mobile device case is molded with resilient materials.

19. A method of manufacturing a holster kit comprising:

molding a mobile device case, the mobile device case having a front portion, a first predetermined configuration, and a second predetermined configuration, the first predetermined configuration and the second predetermined configuration being differently dimensioned;

molding a base to include an at least substantially planar portion sized to contour the front portion of the mobile device case, the at least substantially planar portion including a plurality of protuberances extending from the at least substantially planar portion, the plurality of protuberances form a first common contact point for the mobile device case when the mobile device case is releasably affixed to the base in both the first predetermined configuration and the second predetermined configuration;

the base having a fixed size to receive the first predetermined configuration and the second predetermined configuration of the mobile device case; and a retention element configured to releasable mate with a corresponding second common contact point in both the first predetermined configuration and the second predetermined configuration, the plurality of protuberances configured to maintain the alignment between the retention element and the second common contact point in both the first predetermined configuration and the second predetermined configuration without changing the position of the second common contact point.

* * * * *